United States Patent [19]

Yanagawa et al.

[11] 4,402,103

[45] Sep. 6, 1983

[54] CLEANING UNIT FOR COPYING MACHINE

[75] Inventors: Nobuyuki Yanagawa, Chigasaki; Yoshiharu Iwanaga, Tokyo; Toyozi Ishikawa, Kawasaki, all of Japan

[73] Assignee: Ricoh Company, Ltd., Japan

[21] Appl. No.: 297,203

[22] Filed: Aug. 28, 1981

[30] Foreign Application Priority Data

Aug. 30, 1980 [JP] Japan ..... 55-123218[U]

[51] Int. Cl.[3] ..... G03G 21/00

[52] U.S. Cl. ..... 15/256.52; 355/15

[58] Field of Search ..... 15/256.52; 355/15, 3 R; 118/652

[56] References Cited

U.S. PATENT DOCUMENTS 3,722,018 3/1973 Fisher ..... 15/256.52

4,097,140 6/1978 Suzuki et al. ..... 355/15

FOREIGN PATENT DOCUMENTS 36290 9/1981 European Pat. Off. ..... 355/15

OTHER PUBLICATIONS

Bresnick; Vacuum-Less Cleaning and Reclaim System for Magnetic Toner/Media; Xerox Disclosure Journal, vol. 5, No. 4, Jul./Aug. 1980.

*Primary Examiner*—Edward L. Roberts

*Attorney, Agent, or Firm*—Guy W. Shoup; Gerard F. Dunne

[57] ABSTRACT

A cleaning roller having a movable surface formed by a brush of a reduced length implanted thereon and internally housing means for producing a magnetic field is disposed in contact with the surface of an electrostatic latent image carrier in order to remove the particle of a developer therefrom. The cleaning roller is in turn disposed in contact with an auxiliary cleaning roller which is effective to remove the developer particle which is trapped by the first mentioned cleaning roller. The auxiliary cleaning roller is in turn disposed in contact with a remover which removes the developer particle from the auxiliary cleaning roller.

18 Claims, 2 Drawing Figures

CLEANING UNIT FOR COPYING MACHINE

BACKGROUND OF THE INVENTION

The invention relates to a cleaning unit for removing the particles of developer which remains attached to the surface of an electrostatic latent image carrier used in an electrophotographic copying machine, an electrostatic recording system or the like.

A variety of cleaning units are known in the art which remove any residual particle of developer from a photosensitive member after an image transfer step. These typically include a fur brush cleaning, a blade cleaning, a roller cleaning, a magnetic brush cleaning and other techniques. A fur brush cleaning technique utilizes a hollow cylinder having a fur brush implanted on its surface and which is driven to rotate at a high speed for removing the toner from the photosensitive member. The toner deposited on the fur brush is removed by paddling the fur brush by means of a striker rod. The removed toner is conveyed by an air suction unit to be collected into a toner filter bag. Frequently, the technique is subject to a number of drawbacks including the dispersion of a toner from the casing of the cleaning unit to cause a contamination of surrounding parts, a degradation in the cleaning effect which occurs as a result of the bristles of the fur brush lying down after a prolonged period of use because of the increased length of the brush, and an increased size of the arrangement which is required. The blade cleaning technique utilizes a resilient blade having a relatively sharp edge as may be formed of polyurethane rubber and which is disposed in abutment against the surface of a photosensitive member. Hence, the surface of the photosensitive member is susceptible to damage. Once it is damaged, the image quality is greatly degraded, requiring a replacement of an expensive photosensitive member. When a photosensitive member is used which has an increased resistance to friction, the kind and arrangement of the photosensitive member is limited, resulting in the loss of flexibility in the design. In the roller cleaning technique, a resilient roller is used having a pliable layer which exhibits a resistivity not greater than $10^8$ ohm-cm. The roller is disposed in abutment against a photosensitive member to remove toner therefrom. However, if a magnetic carrier remains attached to the surface of the photosensitive member, the resilient roller is incapable of reliably removing it. In addition, there remains the likelihood that the photosensitive member may be damaged as with the blade cleaning technique. The magnetic brush cleaning technique, though it is little likely to damage the photosensitive member, has a reduced mechanical rubbing effect upon the surface of the photosensitive member, which prevents a satisfactory cleaning effect from being achieved. In addition, after a prolonged period of use, the toner concentration in the magnetic brush increases, resulting in a greatly reduced cleaning performance unless such toner is removed beforehand. It is also contemplated to use a cleaning roller comprising a sleeve on which bristles are implanted, but an increased number of revolutions of the sleeve causes an increase in the noise level from an associated drive motor and requires an increased torque. In addition, centrifugal effects causes the dispersion of the toner into the surrounding environment.

As discussed above, all of the described cleaning techniques are advantageous in some respect but are disadvantageous in others, and the prior art fails to provide an optimum cleaning technique. Thus it will be apparent that there is a need for a cleaning unit which is compact in construction while providing a high cleaning effect and avoiding a degradation in its performance with time and avoiding any damaging of a photosensitive member.

SUMMARY OF THE INVENTION

In view of the foregoing, it is an object of the invention to provide a cleaning unit for a copying machine which eliminates the above disadvantageous of the prior art.

The above object of the invention is achieved by the provision of a cleaning unit for copying machine which is used to remove developer particles from the surface of an electrostatic latent image carrier of a copying machine. The cleaning unit comprises a cleaning roller having a movable surface having a brush of a reduced length implanted thereon and internally housing means for producing a magnetic field, an auxiliary cleaning roller disposed for rotation while being maintained in engagement with the cleaning roller so as to remove developer particle therefrom, and a remover disposed in abutment against the surface of the auxiliary cleaning roller for removing developer particle therefrom.

In accordance with the invention, the cleaning roller internally housing means for producing a magnetic field and having a brush formed on its surface is disposed in contact with the surface of an electrostatic latent image carrier, so that any developer particles which remain attaching to the surface of the carrier is removed therefrom by adherence to the brush and under the influence of the magnetic attraction when the electrostatic attraction between the particles and the carrier is reduced as their relative position changes, thus enhancing the cleaning effect. The reduced length of the cleaning brush prevents the brush from lying down, thus assuring a stabilized cleaning operation over a prolonged period of time. Since any developer attached to the cleaning brush is magnetically removed to maintain it clean, a high cleaning effect can be maintained. The cleaning unit is simple in construction and small in size.

In other aspect of the invention, the brush may be formed of conductive fibers, thereby providing an enhanced cleaning performance by causing the relative position of any residual developer and the carrier to be changed, or stated differently, causing the developer which remains electrically attracted to the carrier to shift, and also by providing a neutralizing effect by removing any residual potential which may exist in a region under the residual developer on the carrier.

DESCRIPTION OF EMBODIMENTS

Figure 1:
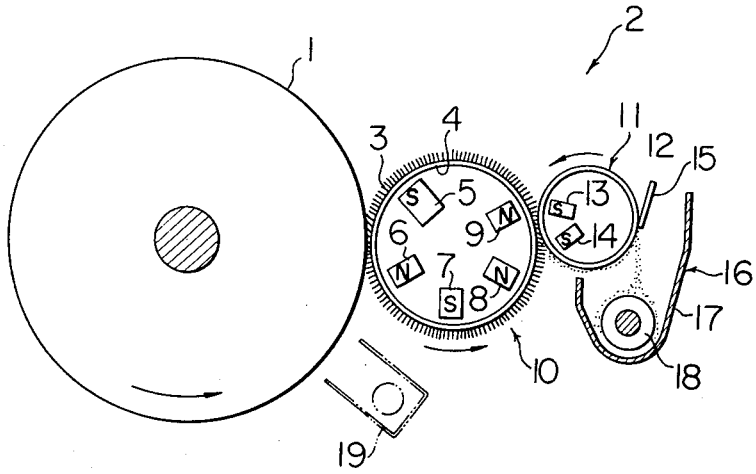
FIG. 1 is a cross section of a cleaning unit according to one embodiment of the invention.

Referring to the drawings, in particular, to FIG. 1, there is shown a cleaning unit according to one embodiment of the invention in cross section. An electrostatic latent image carrier is shown as photosensitive drum 1 which is adapted to rotate counterclockwise at a given constant speed. The drum 1 may comprise a photosensitive material such as selenium, zinc oxide, organic photoconductive material and the like. An electrostatic latent image is formed on the drum surface by an electrophotographic process. The latent image is converted into a visual image by means of a developing unit, not shown. The developer may comprise a one-component developer formed by a magnetic toner. The toner image thus formed is electrostatically transferred onto a transfer sheet. However, it is to be noted that the toner is not transferred in its entirety, but part of the toner remains on the drum surface. A cleaning unit 2 is provided in order to remove such residual toner, and is located in a region adjacent to the drum surface which extends upwardly. The unit 2 comprises a hollow cylinder 4 having a number of brushes fixedly mounted on its surface, and a plurality of magnets 5, 6, 7, 8, 9 which are fixedly disposed inside the cylinder 4. The combination of the cylinder and the magnets forms a cleaning roller 10. The cylinder 4 is formed of a non-magnetic sleeve, and is adapted to rotate counterclockwise. The relative position of the cylinder 4 with respect to the drum 1 is chosen so that the brushes 3 on the surface of the cylinder 4 contact the drum surface with a given pressure. The brushes 3 have a reduced length, on the order of about 0.5 mm, and are hence free from the effects of lying down. Magnets 8 and 9 are both of a like polarity, but the other magnets have polarities which are chosen so that adjacent magnets present poles of opposite polarities. As the cylinder 4 rotates in the manner illustrated, any toner which remains attaching to the drum surface 1 is initially rubbed by the brushes 3, formed of fibers, whereby it is removed from the drum surface to be carried by the brushes. On the other hand, the magnets 5 to 9 which are disposed inside the cleaning roller 10 function to attract any fraction of toner which is not removed by the brushes 3 toward the sleeve 4 and away from the drum surface in a magnetic manner. It should be understood that the magnetic attraction occurs simultaneously with the rubbing effect by the brushes 3.

An auxiliary cleaning roller 11 is disposed on the side of the cleaning roller 10 which is opposite from the drum 1, or to the right of the cleaning roller 10 as shown, for contact with the brushes 3 on the cleaning roller 10. As shown, the auxiliary cleaning roller is driven by suitable means, not shown, to rotate counterclockwise. The auxiliary roller comprises a non-magnetic sleeve 12 and a pair of magnets 13, 14 fixedly disposed inside the sleeve 12. It is to be understood that the auxiliary roller 11 may rotate in the clockwise direction. Both of the magnets 13, 14 are of a like polarity, and are of the opposite polarity from the magnets 8, 9 disposed inside the cleaning roller 10. The interaction between these magnets causes the toner carried by the cleaning roller 10 to be transferred onto the auxiliary roller 11 magnetically. The magnetic attraction by the magnets 13, 14 alone is sufficient where the magnetic toner is utilized, but if a two-component developer is used, it is necessary that a voltage of the opposite polarity from that of the toner be applied to the sleeve 12 or that the sleeve 12 be charged to the opposite polarity from the toner by triboelectric charging action between the sleeve 12 and the brushes 3, thereby producing an electrostatic attraction which is applied to the toner. To scrape any developer which is deposited on the sleeve 12 therefrom, a remover 15 such as a doctor blade is disposed in abutment against the surface of the sleeve. The remover is formed of a non-magnetic material such as urethane rubber. The developer removed by the remover 15 falls down to be collected by a collector 16. The collector 16 comprises a vessel 17 which receives the falling developer, and a screw 18 disposed in the bottom of the vessel 17 for conveying the developer in a direction parallel to the rotary shaft thereof. While not shown, the developer may be conveyed by the screw 18 to be returned to a developing unit or a toner replenishing unit. Obviously, it may be fed into a devoted container for disposal. It should be understood that the collector 16 may simply comprise a container which is detachably mounted.

To improve the cleaning performance by efficiently eliminating any deposition of developer on the drum 1, a neutralizer 19 may be disposed at a position preceding the cleaning unit 2, as indicated by phantom line in FIG. 1, thus achieving a substantial elimination of any residual charge in order to diminish the electrostatic attraction acting between the drum and the developer. Such neutralizer 19 may comprise a neutralizing lamp, neutralizing corona charger or a combination thereof. It will be appropriate to describe here the relationship between the neutralizer 19 and the invention. As is known, the neutralization before charging step cannot entirely remove any residual charge from a region of the drum where developer particles are deposited. This results in a low efficiency in removing the developer if the magnetic or electrostatic attraction is relied upon because the attraction of an increased magnitude is required. However, when the residual charge is previously eliminated as described in connection with the present embodiment, the charge is eliminated from a region surrounding the developer, so that as the brushes **3*b* rub against the developer during the cleaning operation, the developer particles are displaced, thus greatly enhancing the opportunity to eliminate the electrostatic attraction acting between the drum 1 and the developer. Simultaneously or subsequently, the cleaning effect by the brushes 3 or the magnetic cleaning effect by the magnets 5, 6** greatly facilitate the removal of the developer.

Figure 2:
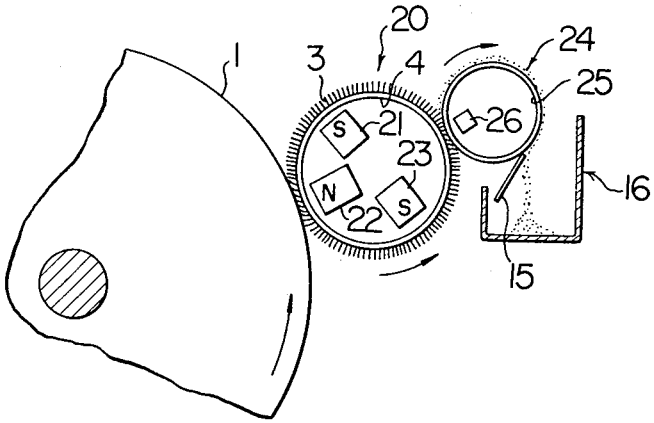
FIG. 2 is a cross section of a cleaning unit according to another embodiment of the invention.

FIG. 2 shows another embodiment of the invention. In this embodiment, similar parts as mentioned above are designated by like reference numerals, and therefore will not be described. A cleaning roller 20 includes a hollow cylinder 4 within which three magnets 21, 22, 23 are fixedly disposed. The magnet 22 is located opposite to the drum 1 while the remaining magnets 21, 23 are disposed on the opposite sides thereof, and these three magnets present poles of opposite polarities to the sleeve. An auxiliary cleaning roller 24 is disposed adjacent to the cylinder 4, but it will be noted that the cylinder 4 has no magnet therein which is located opposite to the auxiliary roller 24. As in the first embodiment, the auxiliary cleaning roller 24 comprises a non-magnetic sleeve 25 and a single magnet 26 disposed therein, generally in the same manner as mentioned in connection with the first embodiment. The removal of the magnetic toner which is deposited on the brushes 3 of the cylinder 4 is achieved by the magnetic attraction exerted by the magnet 26. It is to be noted that the sleeve 25 is rotatably mounted on a shaft, not shown, so that when the cleaning roller 20 rotates counterclockwise, the frictional engagement between the brushes 3 and the sleeve 25 causes the latter to rotate in following relationship, or clockwise. In the first embodiment described above, the auxiliary roller 11 may comprise a magnetic material. In this instance, any developer deposited on the brushes can be magnetically attracted without using a magnet or magnets. It is believed that this is possible as a result of the magnets 8, 9 within the cleaning roller 10 which are disposed in opposing relationship with the auxiliary roller 11 to form a closed loop for the magnetic lines of force.

It is to be understood that the electrostatic latent image carrier is not limited to a drum of photosensitive material, but may comprise a belt-shaped photosensitive member, or a dielectric material which may be repeatedly used in place of a photosensitive member.

In the first and the second embodiment described above, it is found that when the brushes 3 are formed of conductive fibers, the residual developer is disrupted to improve the cleaning performance, and additionally the residual potential on the drum is removed. In this instance, the brushes 3 are obviously connected to the ground by means, not shown. As mentioned previously, the application of neutralizing means (refer to 19 in FIG. 1) before the mechanical and magnetic removal of the developer which remains on the drum surface cannot completely eliminate the electric potential from the regions of the drum where the developer is deposited. Consequently, the disruption of the residual developer by the conductive brushes 3 provides a leak path for the residual potential while causing a relative displacement between the developer and the drum surface.

What is claimed is:

1. A cleaning unit for use in a copying machine for removing developer particles from the surface of an electrostatic latent image carrier; comprising a cleaning roller having a movable surface on which brushes of a reduced length are implanted and adapted to move in contact with the surface of the carrier and having means for generating a magnetic field disposed therein, an auxiliary cleaning roller disposed for rotation and disposed in contact with the cleaning roller for removing developer particles from the cleaning roller, and a remover for removing developer particles from the auxiliary cleaning roller.

2. A cleaning unit according to claim 1 in which the cleaning roller comprises a sleeve formed of a non-magnetic material and adapted to rotate in the opposite direction from the carrier at a point where it is located opposite to the carrier, and wherein ~~the said~~ means for generating a magnetic field is a plurality of magnets which are fixedly disposed inside the sleeve.

3. A cleaning unit according to claim 2 in which the brushes formed on the surface of the sleeve have a length on the order of 0.5 mm.

4. A cleaning unit according to claim 2 in which the said plurality of magnets is at least three magnets located opposite to the carrier and presenting their poles toward the sleeve, one of which plurality of magnets is of the opposite polarity from those of its adjacent magnets.

5. A cleaning unit according to claim 2 in which the said plurality of magnets is at least three magnets disposed opposite to the auxiliary cleaning roller and presenting their poles toward the auxiliary roller, one of which said plurality of magnets is of the same polarity as those of its adjacent magnets.

6. A cleaning unit according to claim 1 in which the auxiliary cleaning roller is driven for rotation in the opposite direction from the cleaning roller in a region where it contacts the cleaning roller.

7. A cleaning unit according to claim 1 in which the auxiliary cleaning roller is disposed for contact with the cleaning roller, whereby it rotates in following relationship with the latter.

8. A cleaning unit according to claim 1 wherein the auxiliary cleaning roller comprises a sleeve of a non-magnetic material and a plurality of auxiliary cleaning roller magnets which are fixedly disposed inside the auxiliary cleaning roller sleeve.

9. A cleaning unit according to claim 8 in which the plurality of auxiliary cleaning roller magnets presents poles of a like polarity toward the auxiliary cleaning roller sleeve.

10. A cleaning roller according to claim 9 in which the said means for generating a magnetic field in the cleaning roller is a plurality of cleaning roller magnets having poles opposite from, and in opposing relationship to, the polarity of the poles of the auxiliary cleaning roller.

11. A cleaning unit according to claim 1 in which the auxiliary cleaning roller comprises a magnetic material.

12. A cleaning unit according to claim 11 in which the said means for generating a magnetic field includes a pair of magnets disposed inside the cleaning roller in opposing relationship with the auxiliary cleaning roller, wherein the magnets of the said pair of magnets are of a like polarity.

13. A cleaning unit according to claim 1 in which the brushes formed on the surface of the cleaning roller are formed of conductive fibers.

14. A cleaning unit according to claim 1 in which the remover comprises a blade disposed in abutment against the surface of the auxiliary cleaning roller.

15. A cleaning unit according to claim 1 in which the developer particles removed from the auxiliary cleaning roller are collected by a container.

16. A cleaning unit according to claim 15 in which the container is associated with conveying means for conveying the collected developer to another location.

17. A cleaning unit according to claim 1 in which neutralizing means is disposed close to the surface of the carrier at a location downstream, as viewed in the direction of movement of the carrier, of a point of contact between the cleaning roller and the carrier.

18. A cleaning unit according to claim 17 to which the neutralizing means comprises a neutralizing lamp.

* * * * *